US006079509A

United States Patent [19]

Bee et al.

[11] Patent Number: 6,079,509

[45] Date of Patent: Jun. 27, 2000

[54] PIPE DIE METHOD AND APPARATUS

[75] Inventors: Robert M. Bee; William T. Livingston, both of Lafayette, La.

[73] Assignee: Robert Michael Bee, Lafayette, La.

[21] Appl. No.: 09/144,128

[22] Filed: Aug. 31, 1998

[51] Int. Cl.[7] ..... E21B 19/07

[52] U.S. Cl. ..... 175/423; 166/75.14; 166/382; 294/902

[58] Field of Search ..... 175/423; 166/75.14, 166/243, 382; 188/67; 294/102.2, 902

[56] References Cited

U.S. PATENT DOCUMENTS

| | | | |
|---|---|---|---|
| 2,156,384 | 5/1939 | Fluellen | 175/423 |
| 2,552,628 | 5/1951 | Boatright | 175/423 |
| 2,814,087 | 11/1957 | Palmer | 175/423 |
| 4,475,607 | 10/1984 | Haney | 175/422 |
| 5,451,084 | 9/1995 | Jansch | 175/423 X |
| 5,609,226 | 3/1997 | Penisson | 175/423 X |
| 5,971,086 | 10/1999 | Bee et al. | 175/423 |

*Primary Examiner*—Frank S. Tsay
*Attorney, Agent, or Firm*—Robert N. Montgomery

[57] ABSTRACT

A die set used in pipe tongs in the oil and gas industry for gripping pipe while threadably coupling pipe joints, the die having electroless nickel plated, non-interrupted knurled teeth having a special shape which reduces die penetration, thereby reducing wall loss due to die penetration, stress cracking and carbon transfer to oil and gas field tubular pipe and especially to corrosive resistive alloy pipe, thus further reducing pipe corrosion.

13 Claims, 6 Drawing Sheets

PIPE DIE METHOD AND APPARATUS

BACKGROUND OF THE INVENTION

1. Field of the Invention

This invention relates generally to pipe tongs used for gripping and threadably joining lengths of pipe and more particularly to dies used therein for gripping chromium pipe without significant marring or otherwise causing surface fracturing of the pipe.

2. General Background

In the oil gas industry pipe tongs are used primarily for threadably engaging and disengaging tubular goods, such as drill pipe or production tubing and the like. Such tongs generally comprise a set of circumferentially spaced bodies called dies, which are rigidly held in a rotatable body which surrounds the locus of the drill pipe body. By means well known within the art, the device can be manipulated into position about the circumference of a length of pipe in a manner whereby the inner sides of the dies, having hardened metal gripping teeth, bite into and frictionally engage a portion of the pipe to be threadably engaged with or disengaged from a second length of pipe. While one of the pipe lengths is retained, the dies within the tong conform with the unrestrained pipe and are camed into locking engagement with the pipe body. The dies and their retaining bodies are then power driven to either engage or disengage the threaded pipe bodies. Such tong dies are available with various tooth configurations which help grip the pipe. Such configurations include transverse mud grooves, which allow the pipe dies to maintain a grip even in contaminated conditions, such as when the pipe is coated with mud and oil. However, it is well known in the art that damage, to the pipe occurs when the dies wear unevenly or when the die teeth become damaged producing jagged edges, in which case stress risers may be set up in the surface of pipe which may result in premature pipe failure. The accepted method of gripping pipe in this manner depends on the ability of the die teeth to penetrate the surface of the pipe to some degree rather than applying excessive force, which may crush or misshape the pipe. This problem is compounded when such dies are used on high chromium pipe. Chromium or other nickel alloy pipe is often used in highly corrosive wells, such as Hydrogen Sulfide ($H_2s$) gas wells. Such pipe is expensive and must be handled carefully to avoid damage to the chromium surfaces which attracts corrosion, thereby leading to early pipe failure. Therefore, a new and better means of gripping such chromium and nickel alloy pipe during the connection make-up or break-out procedure is required in order to prevent damaging the chromium pipe surfaces. A problem also exists when the hardened, high carbon, steel teeth on the dies make contact with the chromium or nickel alloyed pipe, thereby exerting high contact pressure. It has been found that such high carbon steel dies tend to transfer small amounts of carbon to the pipe at each penetration point. Such carbon transfer spots have been found to set up sites for corrosion which lead to stress cracks in the pipe. It has been found that carbon creates galvanic action, thereby hardening pipe in the same manner as hydrogen sulfide, causing brittleness of the metal.

Tests on chrome pipe with salt spray have shown that any discontinuity in the surface of the pipe causes a deterioration of between 0.011–0.015 loss in pipe wall thickness per year. For example, a number 13 chrome pipe having 0.217 wall thickness with a 0.028 penetration coupled with 0.015 corrosion factor per year accelerates corrosion deterioration exponentially.

Others in the art have attempted to address the problem of handling chromium pipe in a manner designed to reduce penetration, such as that disclosed by U.S. Pat. No. 5,451,084 wherein strips having hard teeth which get progressively softer along its length are held in a resilient base to allow flexibility. However, such structures fail to address the problem of sharp tooth edges resulting from mud grooves cut vertically through the tooth configuration and the problem of carbon transfer to the pipe body.

Slip, elevator and tong dies all rely on the biting action of the die's teeth into the pipe body for griping the pipe. However, recently the industry has begun addressing these problems by attempting to reduce stress induced into the surface of the pipe through better fits, flexible die seats, etc. However, to date, slip dies still generally produce penetrations of between 0.017–0.028 of an inch with pipe loads of 14000 ft. with up to 100% carbon transfer. Tests show that pipe marred by pipe dies have penetration depths of up to 0.075 of an inch and consistently result in high carbon deposits in the penetrations of the pipe. Therefore, when such pipe is used in high corrosive wells, they last only a few weeks. However, the industry still considers die penetration of the surface of the pipe to be a necessary evil. However, it is becoming essential that such penetration by the die teeth into the pipe body must be kept to a minimum, generally in the order of less than 0.002/1000 of an inch. Many of the prior art dies have been found to have numerous chips and cracks on the teeth prior to use as a result of the heat treating and handling process. Such pre-use chipping, as well as the normal use chipping of the teeth, results in sharp edges which cut and mar the pipe surface even further and increase the amount of carbon deposited in the pipe penetrations.

SUMMARY OF THE INVENTION

The present invention addresses the issues raised by the above discussion. Since it has been established that pipe dies generally must penetrate the surface of the pipe in order to maintain a positive grip and thus avoid crushing the pipe and it is essential that this penetration be kept to a minimum, the concept of the present invention is therefore to provide dies which have a minimum number of teeth corners or edges, which tend to break and/or dig into the pipe body, make minimum penetration, and provide a hard, non-carbon coating over the die teeth which will prevent carbon transfer to chromium or other such nickel alloy pipe.

It is therefore an object of the invention to provide a pipe die having the ability to grip a pipe with a minimum penetration of less than 0.002/1000 of an inch without leaving carbon deposits in such penetrations.

It is still a further object of the invention to provide a pipe die having a minimum number of sharp edges which could cause cuts or otherwise mark the surface of a pipe, especially chromium or nickel alloy pipe while still providing sufficient pipe contact.

BRIEF DESCRIPTION OF THE DRAWINGS

For a further understanding of the nature and objects of the present invention, reference should be made to the following detailed description taken in conjunction with the accompanying drawings, in which, like parts are given like reference numerals, and wherein.

DETAILED DESCRIPTION OF THE PREFERRED EMBODIMENT

Figure 7:
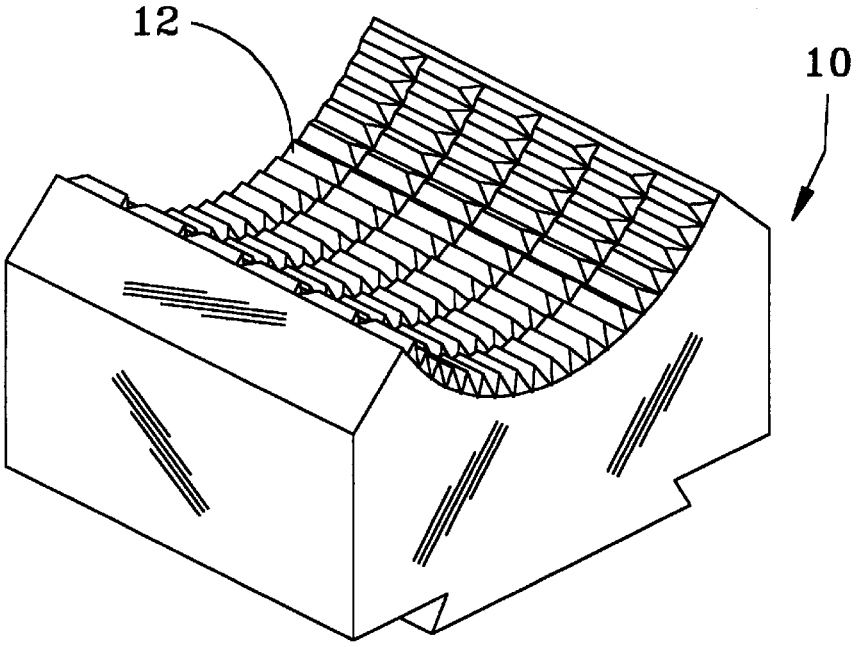
FIG. 7 Prior Art
FIG. 7 is an isometric view of a prior art die with longitudinal teeth.
Figure 8:
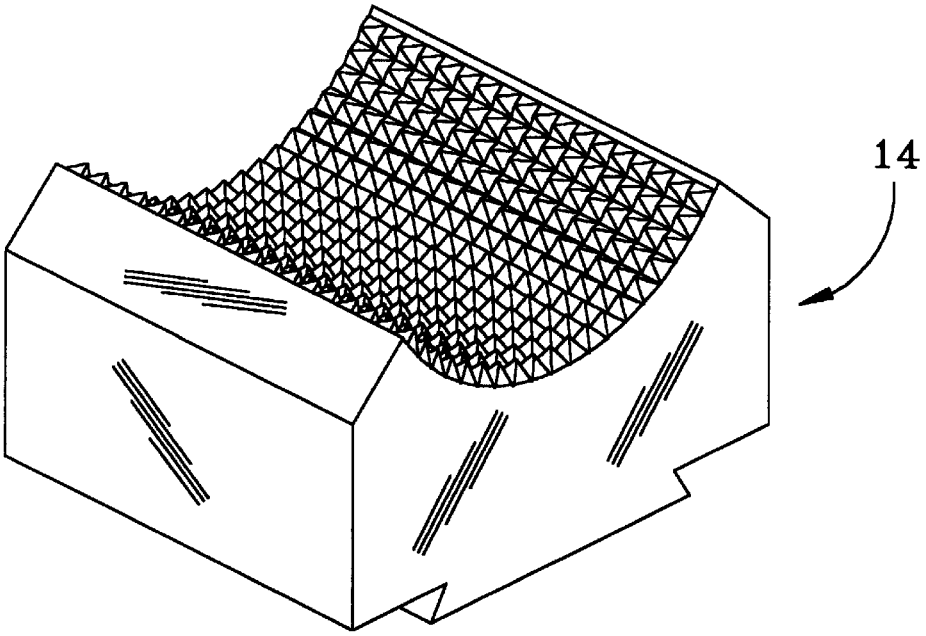
FIG. 8 Prior Art
FIG. 8 is an isometric view of a second prior art die with perimid teeth.
Figure 9:
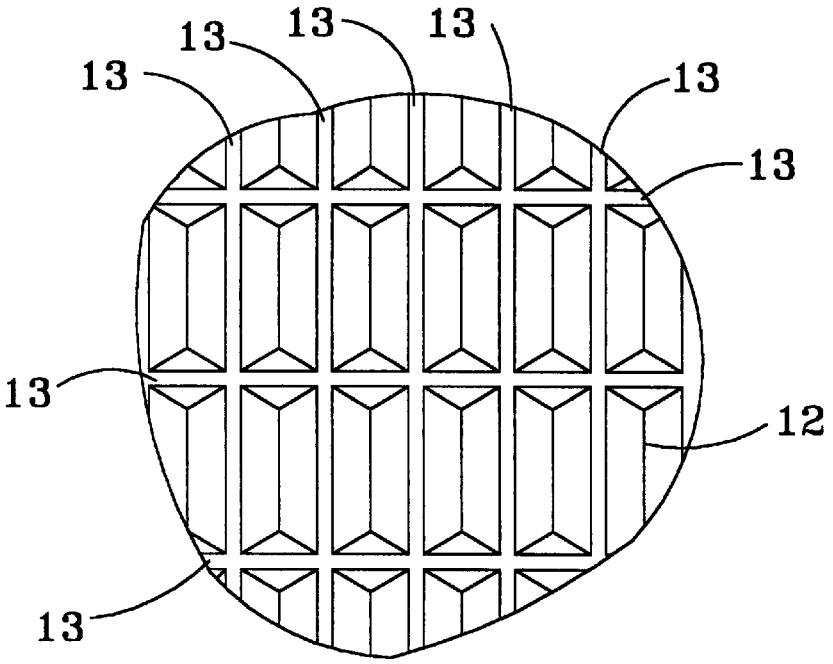
FIG. 9 Prior Art
FIG. 9 is a close partial view of the prior art teeth illustrated in FIG. 7.
Figure 10:
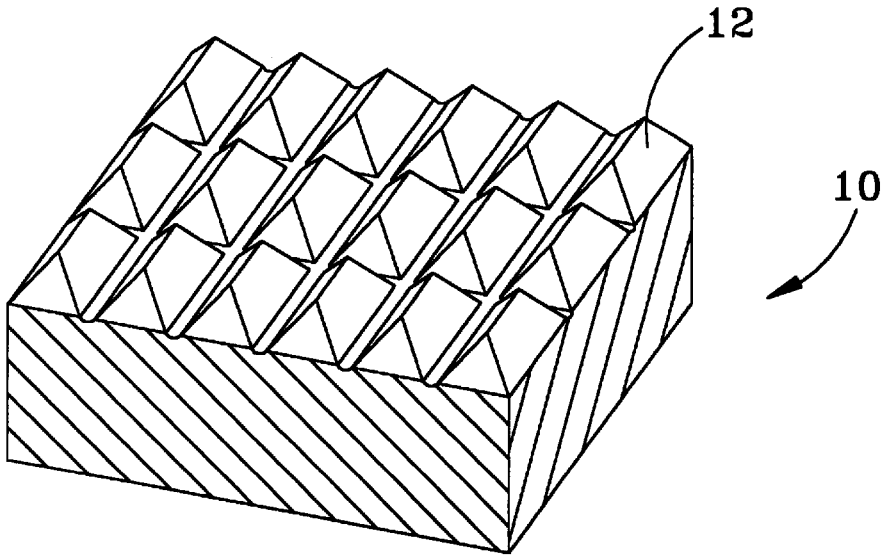
FIG. 10 Prior Art
FIG. 10 is a close partial view of the prior art teeth illustrated in FIG. 7.
Figure 11:
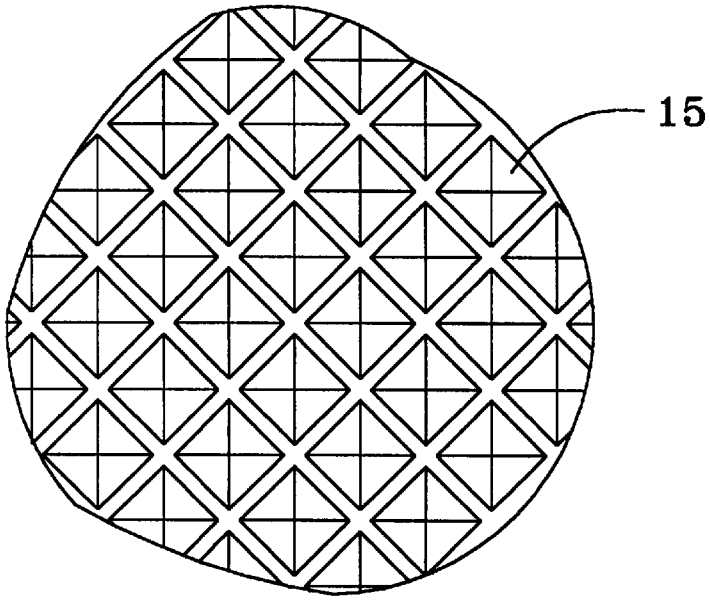
FIG. 11 Prior Art
FIG. 11 is a close partial view of the prior art teeth illustrated in FIG. 8.
Figure 12:
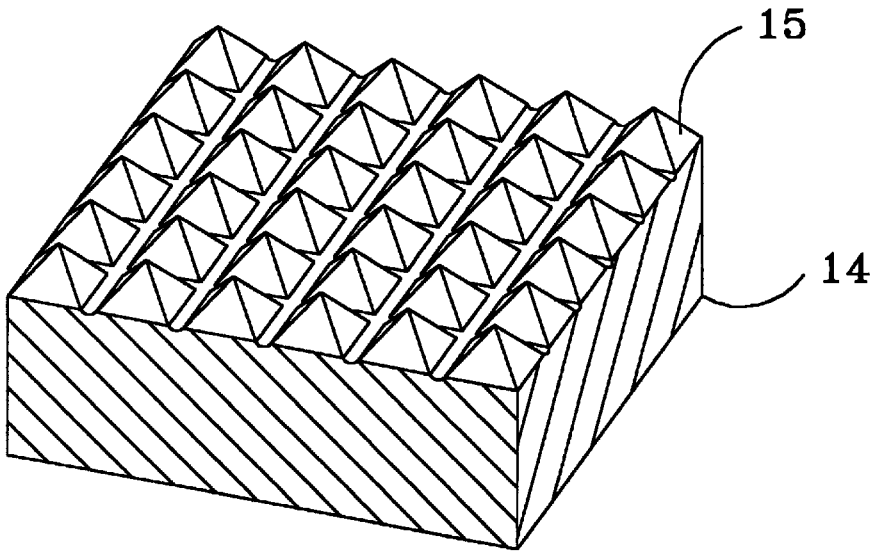
FIG. 12 Prior Art
FIG. 12 is a close partial view of the prior art teeth illustrated in FIG. 8.

As seen in the prior art drawings in FIGS. 7, 9 and 10, tong dies 10 are generally configured with relatively large vertical teeth 12 divided in to rows by perpendicular oil grooves 13. However, some more recent dies 14 have rows of pyramid teeth 15, as seen in FIGS. 8,11, and 12, thus giving them bi-directional frictional griping capability. However, to maintain a sustained grip on a tubular member such large teeth 12 must be sharp and usually make deep penetration within the surface of the tubular member 14 seen in FIG. 1.

Figure 1:
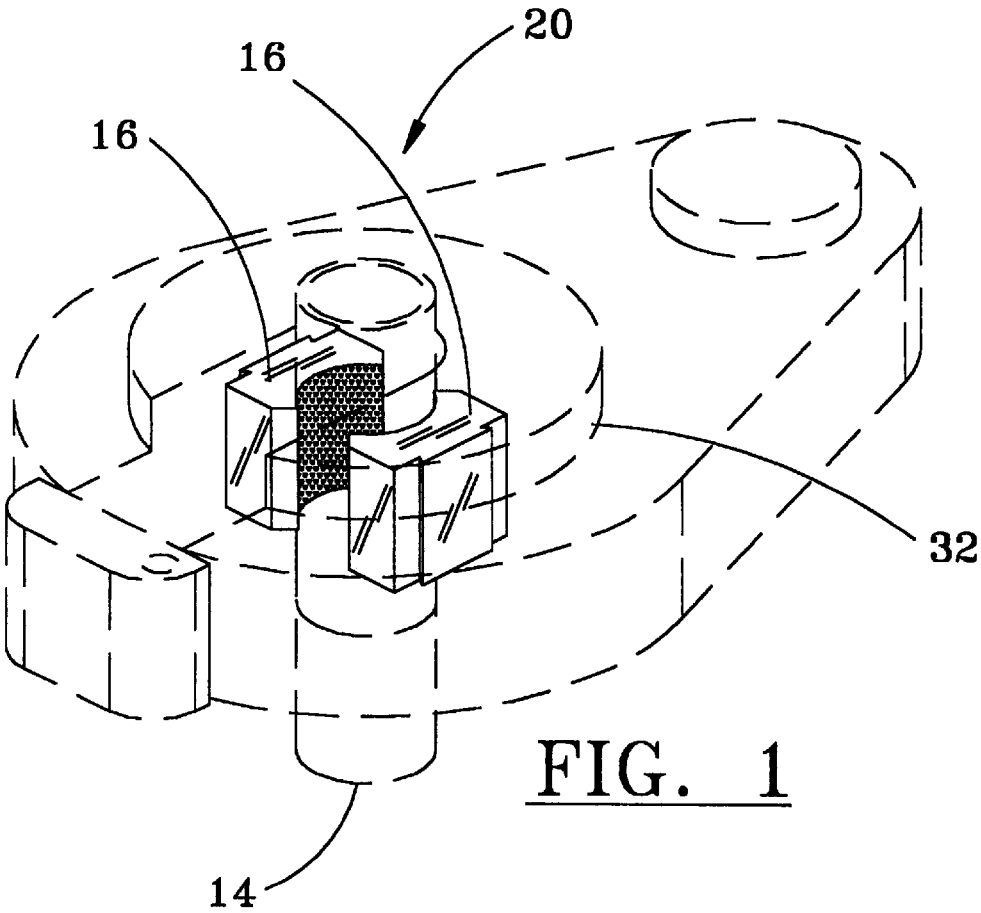
FIG. 1 is an isometric view of a typical pipe tong die arrangement.
Figure 2:
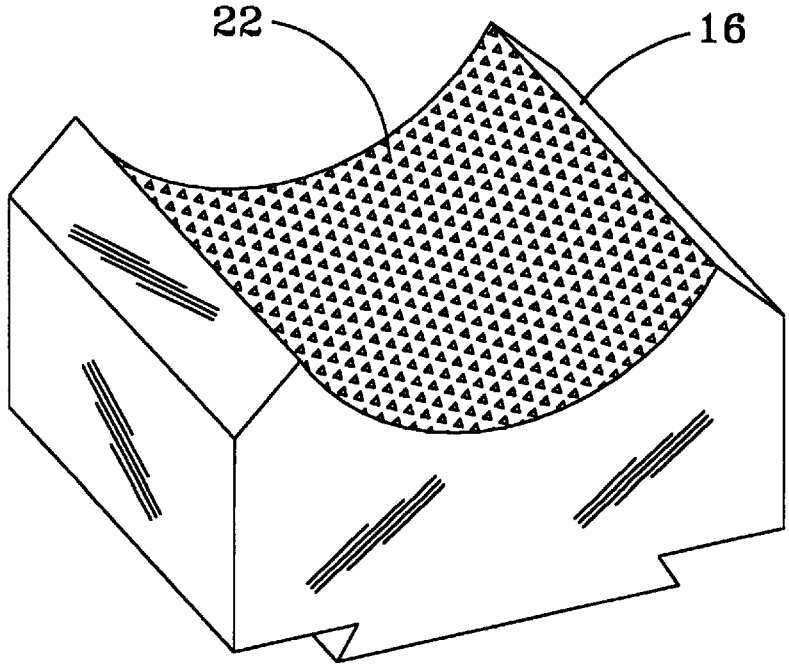
FIG. 2 is an isometric view of the preferred embodiment of a tong die.
Figure 3:
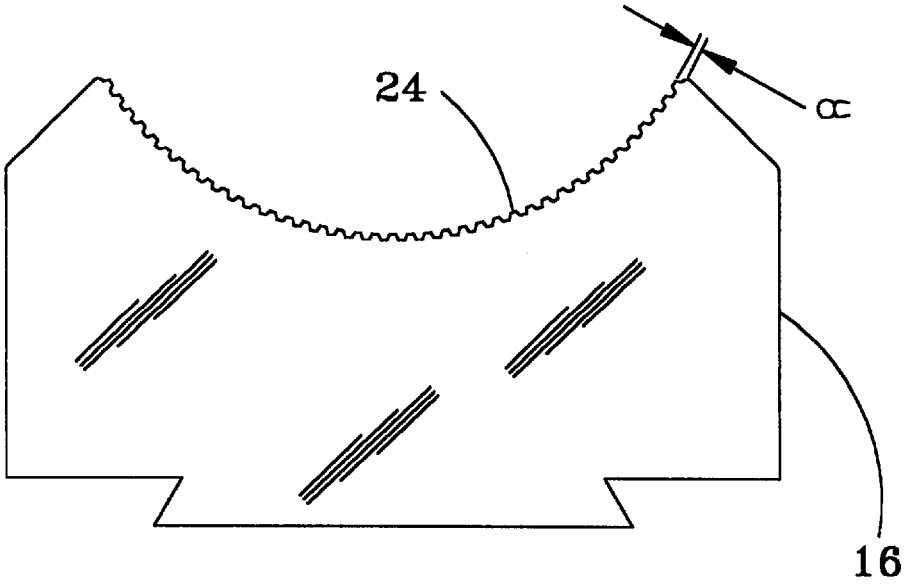
FIG. 3 is an end view of the preferred embodiment illustrated in FIG. 2.
Figure 4:
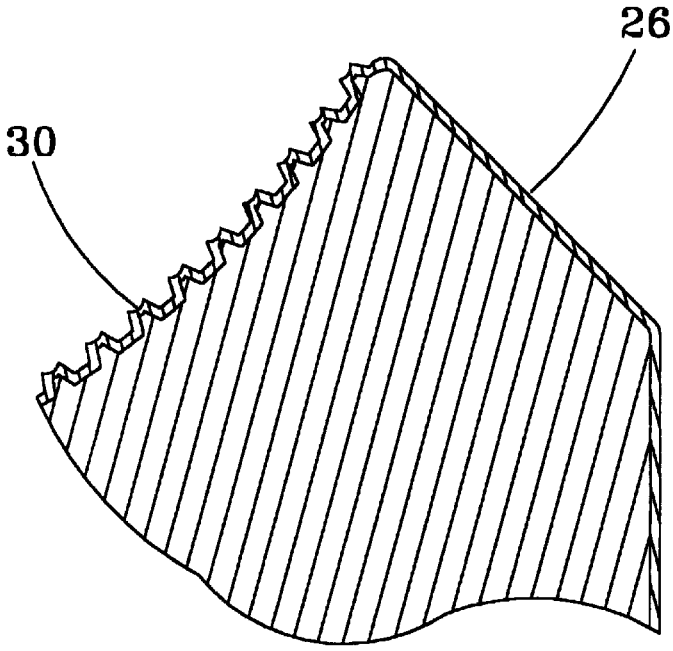
FIG. 4 is partial cross section view of the preferred embodiment.

The preferred embodiment 16 illustrated in FIG. 1, located within a typical tong assembly 20, engages the pipe 14 in the same manner typical within the tong art. The tooth pattern 22 shown in FIG. 2 is a special knurling which forms an unusual raised griping surface which may be applied to any tong die 16 regardless of manufacturer. As illustrated in FIG. 3, the height $\alpha$ of each of the raised geometric shapes, herein referred to as teeth 24, as shown in profile in FIG. 4, are relatively small as compared to the prior art tong die teeth 12. This helps prevent tooth penetration of the pipe surface and the high number of teeth per square inch further provides even distribution of pressure on the pipe member 14.

Figure 5:
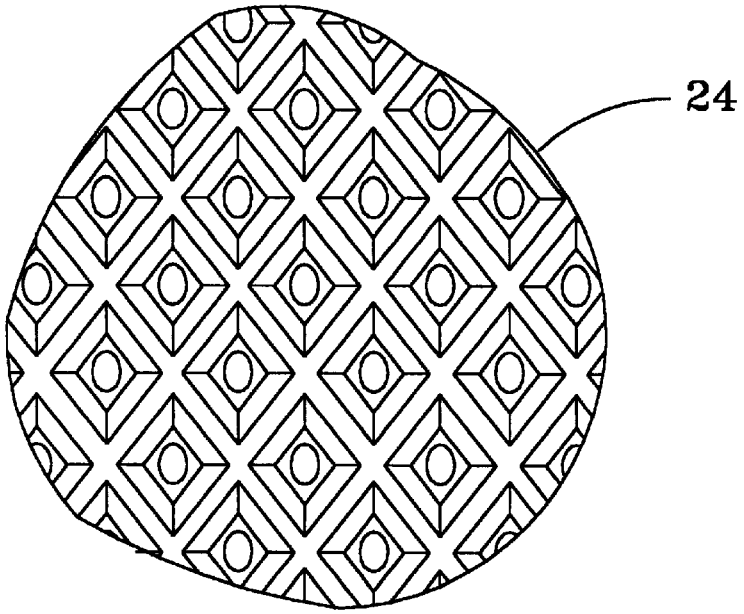
FIG. 5 is partial top view of the preferred embodiment tooth pattern.
Figure 6:
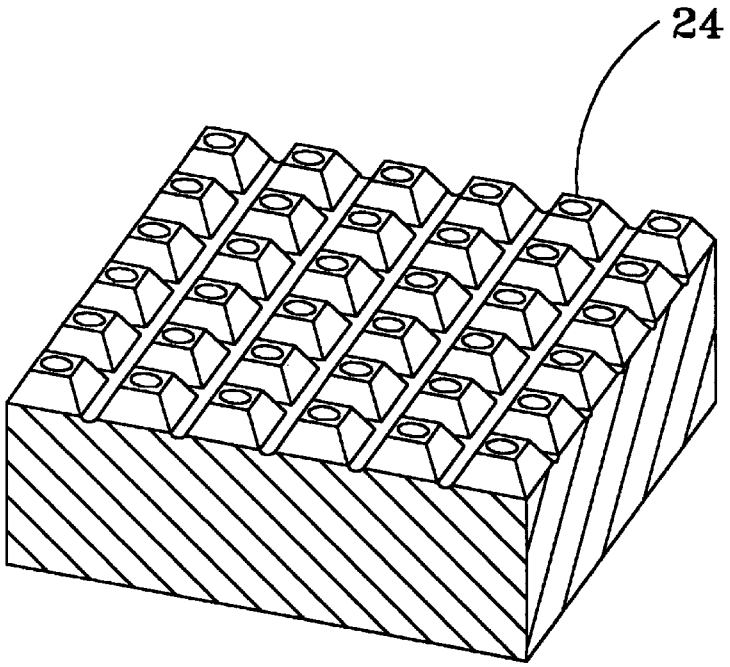
FIG. 6 is a partial isometric cross-section view of the preferred embodiment tooth pattern.

The tong die partial assembly 20 shown in FIG. 1 illustrate how the die sets are positioned, with each die having a partial radial surface in contact with the pipe surface radii emanating along a vertical longitudinal center line. The dies 16 are constructed from 8620 steel with a preferred tooth embodiment as seen in FIGS. 5 and 6. The knurled pattern 22 illustrated in FIG. 2 produces a raised diamond shape, cut on the diagonal with 30 degree spiral right and left hand circular pitch knurls having 10 TPI (teeth per inch) /20T to a depth $\alpha$ of 0.021 of an inch in one direction and slightly shallower depth of approximately 0.020 of an inch in the opposite direction, with a root radius of 0.007 of an inch. The die 16 is deburred to remove all sharp edges and heat treated to a double case depth of 0.030 to 0.040 of an inch and a hardness of Rc. of 65. The difference in knurling depth in the opposite direction produces an over-cut, which tends to break the sharp tips of each tooth and dimple the tooth as illustrated in close-up by FIGS. 5 and 6. The knurling process is also a far less expensive machining method for forming a gripping surface than cutting specific teeth in a pipe die, thereby making this die more economical.

A special coating 26 illustrated in FIG. 4 is a 0.0002 to 0.0007 thick coating of hard chrome or electroless nickel in solution, chemically disposed by ionic transfer. This process provides a thin, very adherent, high quality, dense chromium deposit. The deposit is ideally suited to configurations such as threads and splines where conventional platings are not practical. The coating exhibits very high degree of hardness and withstands high temperatures. This coating has proven to achieve superior corrosion and wear characteristics when used in corrosive atmospheres. It has also exhibited excellent resistance against chipping, cracking or separation from the base material.

The dimpled tooth tips 30 and the plating 26 illustrated in FIG. 4 reduce the tooth penetration drastically.

Tests indicate pipe in general and chromium pipe in particular can be held successfully with the instant tong die 16 with virtually no visual pipe marking and only 0.0005/1000 penetration. Such test have also shown a loss of contact area on the dies of less than 5% and effecting a carbon transfer of only 1% of the contact surface area of the pipe 14 after running hundreds of pipe joints with applied torque's of up to Twelve thousands foot pounds. Therefore, a 0.0005/1000 of an inch penetration and carbon transfer rate of 1% drastically reduces the rate of corrosion and possibility of stress cracking leading to pipe failure.

Testing has also indicated that the handling of pipe tong dies plays an important role in the degree of damage done to the surface of pipe. The tong must cam the dies 16 into contact with the pipe by rotating the die assembly 32 shown in FIG. 1 in order to bring the dies'teeth into gripping contact with the pipe. A great deal of slip scarring on the pipe occurs as a result of the large shape teeth 12 illustrated in FIG. 7. However, with the preferred embodiment dies 16 having smaller teeth and less penetration, and if the tongs are handled correctly, less rotation is required to cam the dies into gripping contact, thus leaving much shallower penetration usually less than 0.002 of an inch and with very little carbon transfer on the pipe surface as a result of the special coating 26.

The knurled die teeth 24 are far less likely to break than the larger teeth of the prior art seen in FIGS. 7 and 8. Having a greater number of contact points protected by a hard coating insures minimum depth penetration while maintaining sufficient grip, thus reducing the number of stress points which may cause damage to the die 16.

A further benefit has been found by using the present die 16. After each pipe run, the tong dies are often replaced and the dies returned to the manufacturer for inspection and replacement or refurbishing. A great deal of time is expended in sand blasting the dies prior to inspection for stress cracks. It has been found that the sand blasting process, which often hides surface stress cracks, is not necessary when the die 16 is plated or coated 26 and can be easily cleaned with solvent prior to inspection, thus reducing labor and cost. Since the plating or coating 26 reduces the stress on the dies and the die suffers less damage due to a reduced number of corners, the dies 16 consistently last longer, thereby further reducing cost.

The present invention therefore extends the art by proving that the need for deep penetration is not necessary and that carbon transfer can be prevented, thus increasing chromium pipe life and reducing cost associated with tong dies.

Because many varying and different embodiments may be made within the scope of the inventive concept herein taught, and because many modification may be made in the embodiments herein detailed in accordance with the descriptive requirement of the law, it is to be understood that the details herein are to be interpreted as illustrative and not in any limiting sense.

What is claimed is:

1. A pipe die insert of the type generally used with pipe tongs in oil and gas drilling operations, the die comprising:

a) an elongated steel die member having a concave face relative a longitudinal axis;

b) a plurality of knurled teeth arrayed over said concave face; and c) a coating means applied to all surfaces of said die, including said knurled teeth, to prevent wear and corrosion.

2. A pipe die according to claim 1 wherein said knurled teeth are diamond shaped having truncated tips with a dimple.

3. A pipe die according to claim 1 wherein said teeth are uniform across said concave face without transverse grooves.

4. A pipe die according to claim 1 wherein said coating means is hard chrome plating of electroless nickel in solution, chemically disposed by ionic transfer, having a thickness of between 0.0001 and 0.0004 of an inch.

5. A pipe die according to claim 4 wherein said hard chrome exhibits a high resistance to wear and having an equivalent hardness in excess of 60 Rockwell "C".

6. A pipe die insert of the type generally used with pipe tongs in oil and gas drilling operations, the die comprising:

a) an elongated steel die member having a concave face along a longitudinal axis;

b) a plurality of uninterrupted diamond shaped knurled teeth arrayed over said concave face without interruption; and c) a hard chrome electroless plating applied to said teeth having a thickness of 0.0001–0.0002 of an inch with a hardness in excess of 60 Rockwell "C".

7. A method of threadably coupling nickel alloy drill pipe with a pipe tong comprising the steps of:

a) replacing a compatible set of die inserts in a tong gripping assembly commonly used for griping said nickel alloy pipe with a replacement set of dies, each die comprising:

i) an elongated steel die member having a concave face along a longitudinal axis;

ii) a plurality of uninterrupted diamond shaped knurled teeth arrayed over said concave face said teeth having a blunted tip and a dimple therein; and iii) a hard chrome electroless plating applied to said die, including said teeth having a thickness of 0.0001–0.0002 of an inch with a hardness in excess of 60 Rockwell "C"; and b) utilizing said tong and said replacement set of dies to engage and threadably couple said nickel alloy pipe without significantly marring surface of said pipe.

8. The method according to claim 7 including the step of repetitiously engaging said nickel alloy pipe with said dies without transferring carbon from said dies to said pipe.

9. The method according to claim 7 includes the step of engaging said nickel alloy pipe with said dies and applying torque thereto with a carbon transfer rate of between 1–2% of the contact surface between said dies and said pipe.

10. A method for reducing cost of inspection and increasing useful longevity of pipe tong dies comprising the step of hard chrome plating said dies with electroless nickel in solution, chemically disposed by ionic transfer, having a thickness of between 0.0001 and 0.0004 of an inch.

11. The method according to claim 10 further includes the step of deburring, leaving said dies without any significant sharp edges.

12. A method of knurling teeth upon the interior concave surface of a tong die comprises the process of knurling in one direction at one depth and knurling in the opposite direction at a second depth thus producing a deformed tooth formation on said surface having a truncated point and having a dimple therein.

13. The method of Knurling according to claim 12 wherein said knurling process includes the use of 30 degree left and right hand spiral, circular pitch knurl to produce a diamond shaped tooth.

* * * * *